United States Patent [19]

Smith, III et al.

[11] Patent Number: 4,627,090

[45] Date of Patent: Dec. 2, 1986

[54] AUDIO FREQUENCY MULTIPLICATION DEVICE

[75] Inventors: Jay Smith, III, Pacific Palisades; Gerald S. Karr, Venice, both of Calif.

[73] Assignee: Smith Engineering, Culver City, Calif.

[21] Appl. No.: 756,734

[22] Filed: Jul. 19, 1985

Related U.S. Application Data

[63] Continuation of Ser. No. 399,690, Jul. 19, 1982, abandoned.

[51] Int. Cl.[4] ..... G10L 5/00

[52] U.S. Cl. ..... 381/34; 381/40

[58] Field of Search ..... 381/29–35

[56] References Cited

U.S. PATENT DOCUMENTS 3,816,664 6/1974 Koch ..... 381/30

4,053,712 10/1977 Reindl ..... 381/30

4,091,242 5/1978 Carrubba et al. ..... 381/30

4,370,524 1/1983 Hiraguri ..... 381/29

OTHER PUBLICATIONS

Specifications Continuously Variable Slope Delta Modulator/Demodulator, Motorola MC3417.

VSC: Variable Speech Control M8 Module.

*Primary Examiner*—E. S. Matt Kemeny

*Attorney, Agent, or Firm*—Price, Gess & Ubell

[57] ABSTRACT

A signal processing device for frequency multiplication of an analog signal by an adjustable multiplication factor. The input analog signal is digitized using a delta modulator and read into a random access memory at a first clock rate. The data is read out of the memory at second clock rate and then converted back to an analog output signal. The multiplication factor is a function of the adjustable ratio of the two clock rates.

6 Claims, 7 Drawing Figures

AUDIO FREQUENCY MULTIPLICATION DEVICE

This is a continuation of application Ser. No. 399,690, filed July 19, 1982, now abandoned.

FIELD OF THE INVENTION

The field of the present invention is audio signal processing, and more particularly, devices for performing frequency multiplication of such audio signals as voice and music.

BACKGROUND OF THE INVENTION

It is well known in the art to digitize speech by performing digital encoding and decoding. For example, Motorola, Inc., Phoenix, Arizona, markets its MC3517/18 series of semiconductor devices, designed for military secure communications devices and commercial telephone applications. This device utilizes a continuously variable slope delta (CVSD) modulator/-demodulator, with a sensitive linear multiplier to change the slope of the delta modulator integrator. The circuit is described in the "Specifications and Applications Information" data sheet for the product, which notes that the CVSD circuitry provides increased dynamic range by adjusting the gain of the integrator. Insofar as applicant is aware, this Motorola product is not designed for use as a frequency multiplier.

Voice processing apparatus are known, such as, for example, those described in U.S. Pat. Nos. 4,121,058, 2,183,248, 2,943,152, 3,863,026, 3,104,284, 3,621,150, 3,920,905, 3,936,610, 3,949,175, 3,965,298, 3,976,842, 3,949,175, 3,634,625, 3,295,107, 3,949,174, 3,681,756 and 3,621,150.

In the apparatus described in 4,121,058, for example, audio data is converted to a digital format at a selectable conversion rate and applied through a microprocessor into memory storage. Stored data is selectively recalled and reconverted into an analog format for reconstruction into human speech at a processing rate independent of the input storage rate.

Another device on the market today is the VSC M8 series module sold by VSC corporation, San Francisco, Calif. This device, described in the data sheet for the product, and apparently the subject of U.S. Pat. No. 3,786,195, uses bucket brigade devices in a single-channel configuration to achieve low-cost speech compression.

Notwithstanding the known art, there exists a need for a low-cost frequency multiplication apparatus which performs frequency multiplication with an acceptable dynamic range. There further exists a need for a frequency multiplication apparatus wherein the multiplication rates may be either greater or lower than unity. The need further exists for an apparatus to fulfill these needs whose design is such that all active elements may be included on a single large scale integrated circuit (LSI) chip. Such a device would find a ready demand in such applications, by way of example only, as music synthesizers music apparatus, and hand-held voice pitch shifting devices.

SUMMARY OF THE INVENTION

The present invention comprises a signal processing device wherein the elements comprising the frequency domain of an input signal are multiplied by a constant, adjustable factor. To achieve frequency multiplication, the principle of time compression/expansion is used. An input analog signal is converted into a digital data signal by a novel CVSD modulator circuit. The rate of conversion is controlled by a first clock input. After digitizing, a time compression/expansion is performed, and finally an output analog signal is produced by a ovel CVSD demodulator circuit. The clock rate to the demodulator is controlled by a second clock rate. The multiplication factor of the device is the ratio of the second clock rate to the first clock rate.

The time compression/expansion is achieved through writing the digital data to, and reading the digital data from, a random access memory (RAM) at different rates. In a time multiplexed fashion, the input data is written sequentially to each location of the RAM, while output data is read sequentially from the RAM. An address multiplexer selects the write or read addresses, which are themselves the output of 10 bit input and output counters.

In the preferred embodiment, a novel continuously variable slope delta (CVSD) modulator is employed. A switch is used to control the delta modulator integrator, which results in an improved signal-to-noise ratio over CVSD circuits employing linear multipliers for the function.

Other features and improvements are disclosed.

DETAILED DESCRIPTION OF THE INVENTION

The present invention comprises a novel audio frequency multiplication device. The following description of the invention is provided to enable any person skilled in the art to make and use the present invention. Various modifications, however, to the preferred embodiments will be readily apparent to those skilled in the art, and the generic principles defined herein may be applied to other embodiments. Thus, the present invention is not intended to be limited to the embodiment shown, but is to be accorded the widest scope consistent with the principles and novel features disclosed herein.

Figure 1:
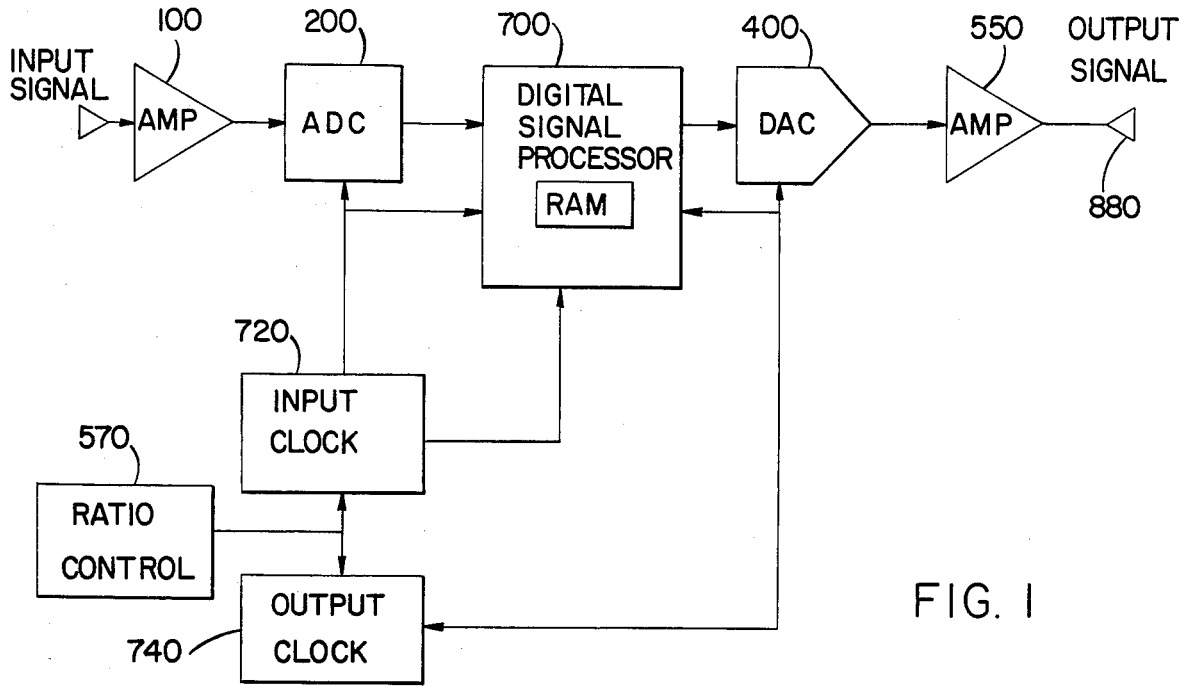
FIG. 1 is a simplified block diagram of the preferred embodiment.

Referring now to FIG. 1, the block diagram of the preferred embodiment is illustrated. The audio input signal may be the output of a microphone, or some other audio frequency apparatus. Amplifier 100 amplifies the input signal and analog-to-digital converter (ADC) 200 converts the amplified signal to digital data, at a sampling rate determined by the input clock generator 720.

The digital data from the ADC 200 is processed by digital signal processor 700. Processor 700 includes a 1K bit RAM, to which the data from ADC 200 is written at the input clock rate, and from which the data is read at a rate determined by the output clock generator 740.

The data from the processor 700 is converted to an analog signal by digital-to-analog converter 400, and amplified by output amplifier 500 for output to a transducer 880.

The digital/analog conversion is performed by novel CVSD modulator and demodulator circuits. The circuits dynamically adapt the step size of the conversion in accordance with the characteristics of the analog input signal, and provide an improved dynamic range and signal-to-noise ratio.

Figure 2:
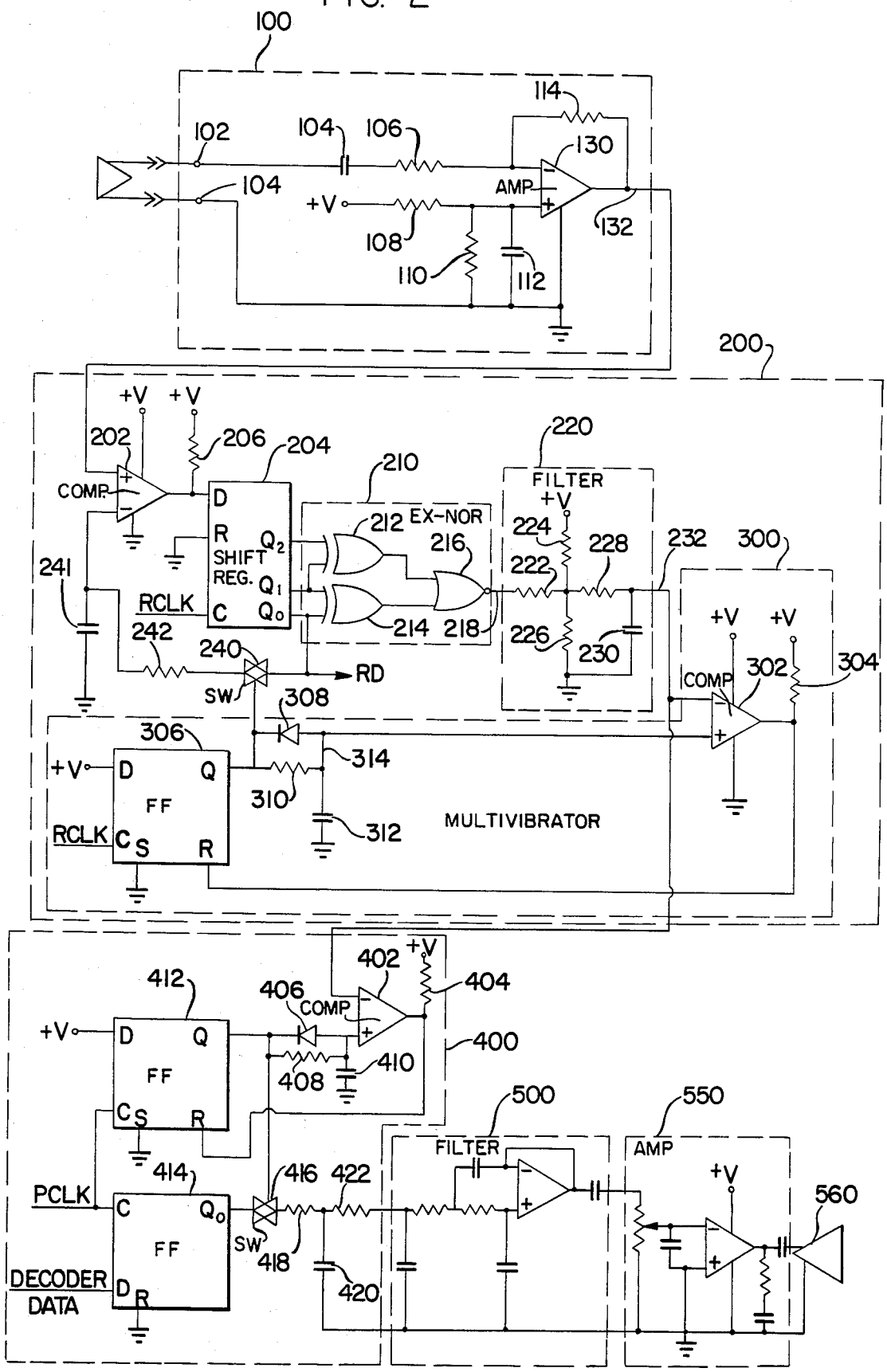
FIG. 2 is a schematic drawing of the main analog circuitry of the emulator circuit of the preferred embodiment.

Referring now to FIG. 2, the emulator circuit of the CVSD modulator and demodulator circuit of the preferred embodiment is illustrated. The input audio voltage signal is applied across nodes 102 and 104 of the input amplifier 100. Amplifier 100 consists of differential amplifier 130 whose inverting input is connected through 0.3 microfarad capacitor 104 and 15 Kohm resistor 106 to node 102. Feedback resistor (220 Kohm) 114 is connected from the output of amplifier 130 to its inverting input. The noninverting input to the differential amplifier 130 is coupled through 150 Kohm resistor 108 to the positive supply voltage V. The noninverting input to the amplifier 130 is also connected to ground through the parallel connection of 100 Kohm resistor 110 and 1 microfarad capacitor 112. Amplifier 130 comprises in the embodiment disclosed a type LM358 amplifier section.

The analog output from amplifier 130 is coupled through line 132 to the noninverting input of comparator 202 of the input delta modulator 200. Comparator 202 is a type LM393 differential amplifier. The output of comparator 202 is coupled to the positive supply voltage through 22 Kohm resistor 206 and also to the data input of shift register 204. Shift register 204 comprises a four-stage shift register of the CD4015 type, in which only three stages are used.

The output of the comparator 202 will either be high or low, depending upon the level of the input signal in relation to the signal level at the inverting input of comparator 202. Shift register 204 is clocked by the input clock signal "RCLK" generated by the oscillator circuit described in FIG. 3. As is well known, the logic level present at the data input to shift register 204 is sampled and transferred into the first register stage Q0, and each sample is shifted over one stage at each positive going clock transition to stages Q1 and Q2. The outputs at Q0, Q1 and Q2 of shift register 204 are respectively coupled into the three inputs of the three-input exclusive NOR gate 210.

Exclusive NOR gate 210 comprises exclusive NOR gates 212 and 214 (CD4030 type units), and CD4001 type NOR gate 216. The output of exclusive NOR gate 210 at line 218 will be high only if all three inputs to the NOR gate 210 are either high or low.

Capacitor 241 (0.01 microfarad) and resistor 242 (68 Kohm) comprise the integrating R-C network which develops the reference level to the comparator 202.

The output of exclusive NOR gate 210 is provided to syllabic filter 220, which comprises 1 Kohm resistor 222, 15 Kohm resistor 224, 15 Kohm resistor 226, 100 Kohm resistor 228, and 0.1 microfarad capacitor 230. The syllabic filter output is provided on line 232 to the one-shot multivibrator circuit designated within phantom line 300.

The multivibrator circuit 300 is a variable pulse-width one-shot multivibrator. Comparator 302 comprises an LM393 type differential amplifier whose inverting input is coupled to the output of syllabic filter 220 on line 232. The output of comparator 302 is coupled through 22 Kohm resistor 304 to the positive supply voltage and also to the reset terminal of D-type flip-flop 306, a type CD4013 unit, clocked by the input clock signal developed in the oscillator circuit of FIG. 3. The data input to flip-flop 306 is the positive supply voltage, which is transferred to the Q output during the positive-going transition of the clock pulse. Resetting is independent of the clock, and is accomplished by a high level on the reset line coupled to the output of comparator 302. The Q output of flip-flop 306 is coupled through 22 Kohm resistor 310 and 470 picofarad capacitor 312 to ground. The Q output of flip-flop 306 is also coupled to the switching gate of switch 240, which is a type CD4016 bilateral switch. Diode 308 is coupled across resistor 310. Node 314 is coupled to the noninverting input of comparator 302.

The network of resistor 310 and capacitor 312 delays the application of the voltage at the Q output of flip-flop 306 to the noninverting input of comparator 302 by the R-C network time constant. While the voltage at the noninverting input to comparator 302 is charging up to the voltage level of the output of the syllabic filter, presented at the inverting input to comparator 302, the switch 240 is turned on, connecting the $Q_o$ output of flip-flop 204 to resistor 242. Once the voltage levels at the inputs to comparator 302 are equalized, the output of comparator 302 goes low, resetting the flip-flop 306 and opening the switch 240.

Thus, gating switch 240 "on" and "off" selectively couples the $Q_o$ sample of shift register 204 to capacitor 241 through resistor 242. Thus, the duty cycle of switch 240 is controlled by the syllabic filter output. For small input amplitudes to the delta modulator 200 or for low frequency signals, the duty cycle will be small. For larger input amplitudes or higher frequency signals, the duty cycle becomes longer.

The output of syllabic filter 220 also controls CVSD demodulator 400. Thus, line 232 is coupled to the inverting input of comparator 402 of delta demodulator 400. Comparator 402 cooperates with flip-flop 412 in a similar fashion as the interaction of comparator 302 and flip-flop 306 of the oneshot multivibrator 300. Thus, the output of the comparator 402 is coupled to the reset terminal of flip-flop 412, a type CD4013 flip-flop. The output of comparator 402 is also coupled to the positive supply voltage through a 22 Kohm resistor 404. The Q output of flip-flop 412 is coupled through a network comprising diode 406, resistor 408 and capacitor 410 to the inverting input of comparator 402. Resistor 408 is a 22 Kohm resistor, and capacitor 410 is a 470 picofarad capacitor, thus having the same time constant as the corresponding circuit in the one-shot multivibrator 300 of the modulator 200. The Q output of flip-flop 412 is coupled to the control gate of switch 416, a type CD4016 bilateral switch. The clock input to both flip-flop 412 and flip-flop 414 is the output clock signal "PCLK," generated by the oscillator circuit in FIG. 3.

Flip-flop 414 is a type CD4015 flip-flop. Its data input is the "DECODER DATA" signal, which is an output from the priority logic circuitry described in FIG. 4. It operates in a similar fashion to the flip-flop 306, with the "DECODER DATA" being presented at the Q0 output to flip-flop 414 with each clock signal. Gating switch 126 "on" and "off" selectively couples this signal through 10 Kohm resistor 418 to the integrating capacitor 420, which is a 0.1 microfarad capacitor. This signal, coupled through 3.3 Kohm resistor 422 comprises the output signal of the output delta demodulator.

Output filter 500 is a low pass filter to remove traces of the clock frequency from the output signal. Output amplifier 550 amplifies the filter signal for presentation to speaker 560.

Figure 3:
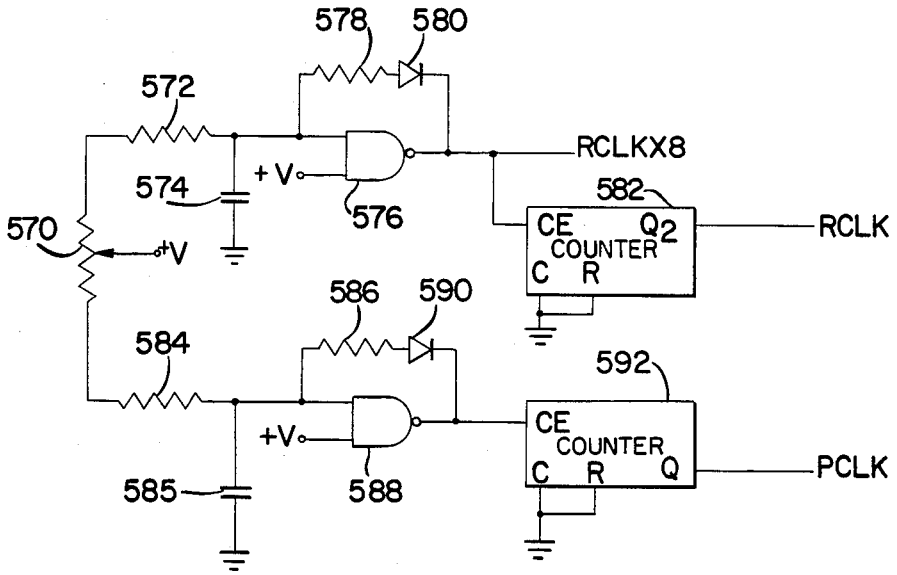
FIG. 3 is a schematic drawing illustrating the clock circuitry of the emulator circuit of the preferred embodiment.

Referring now to FIG. 3, the oscillator circuit will be described, which generates the input clock signal and the output clock signal. Potentiometer 570 comprises the pitch adjustment which is controlled by the operator. It controls not only the frequency of the input clock, but also that of the output clock. Thus, when the operator increases the input clock frequency, the output clock is decreased, and vice versa. This keeps both clock rates above a minimum level to give a higher sampling rate and better fidelity. Potentiometer 570 comprises a 10 Kohm potentiometer. Resistor 572 comprises a 10 Kohm resistor, which is connected to ground through 0.001 microfarad capacitor 574. NAND gates 576 and 588 comprise type CD4093 NAND gates. One output of NAND gate 576 is shunted to the output through 2.7 Kohm resistor 578 and diode 580. Similarly, one output of NAND gate 588 is shunted through 1 Kohm resistor 586 and diode 590 to its output. The output of NAND gate 576 comprises the "RCLK" signal and is also coupled to the clock enable input of divide by 8 counter 582. Counter 582 comprises a Type MC14520 unit, as does divide by 8 counter 592. The Q2 output of counter 582 comprises the input clock signal "RCLK," while the Q0 output of counter 592 comprises the output clock signal "PCLK." Other component values of the oscillator circuit is the 6.8 Kohm resistor 584, 0.1 microfarad capacitor 585, 1 Kohm resistor 586. Typical input clock signals are in the range of 20 to 30 kilocycles.

Figure 4:
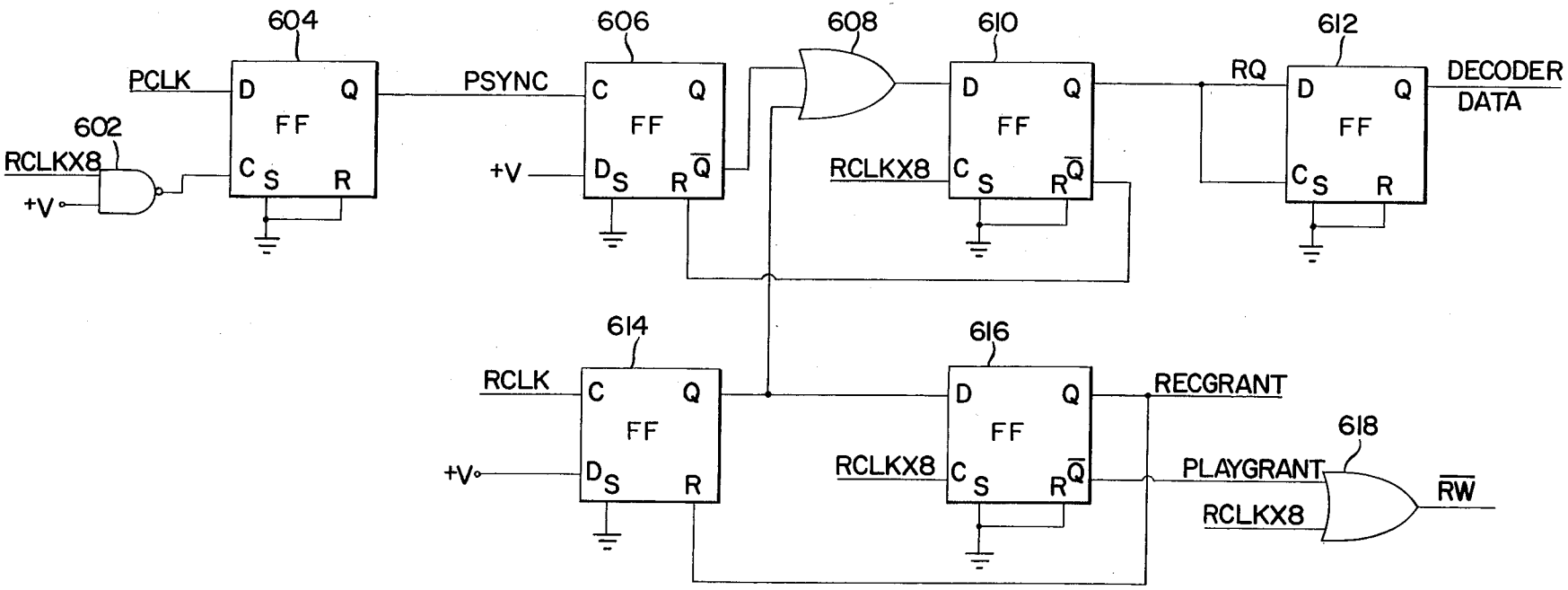
FIG. 4 illustrates the priority logic circuitry of the emulator circuit of the preferred embodiment.
Figure 5:
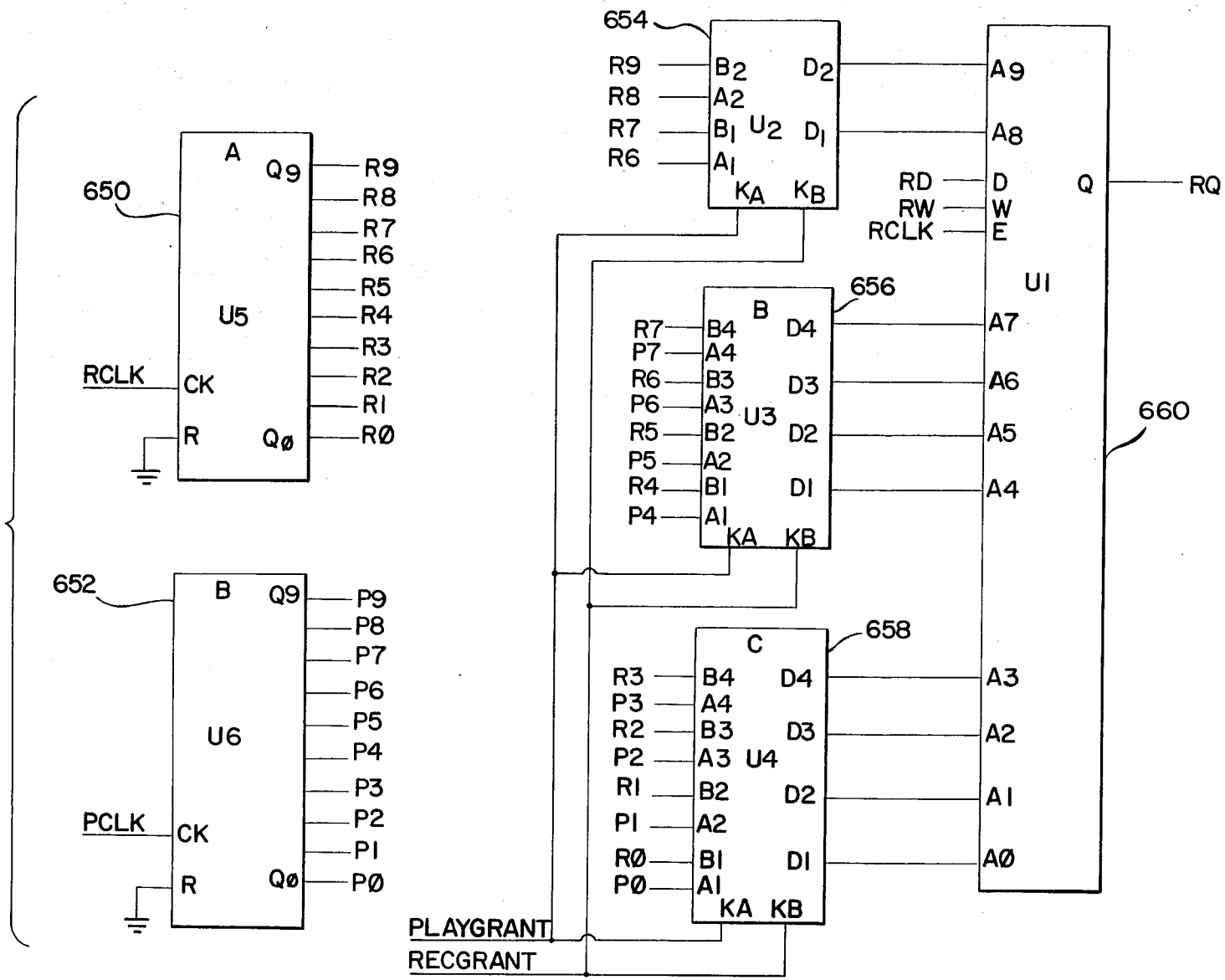
FIG. 5 is a schematic drawing illustrating the multiplexing and memory storage circuitry of the emulator circuit of the preferred embodiment.

Referring now to FIGS. 4 and 5, the priority logic, multiplexing and memory circuitry will now be described. The output data from the input delta modulator is written into a random access memory and subsequently read for output via a multiplexing arrangement. The priority logic circuitry of FIG. 4 operates to control the writing and reading operations from the random access memory (RAM). Multiplexing of the read and write operations is necessary in order that conflicts between reading and writing are resolved, writing being given priority over reading.

Flip-flop 604 in FIG. 4 serves to synchronize the output clock to the input clock times 8 frequency. Flip-flop 604, as well as flip-flops 606, 610, 612, 614 and 616 comprise type CD4013 flops. The data terminal of flip-flop 604 is coupled to the output clock signal "PCLK." The clock terminal of flip-flop 604 is coupled to the output of NOR gate 602. The data input to NAND gate 602 is the input clock times 8 frequency signal "RCLKX8." The other terminal of gate 602 is coupled to the positive supply voltage. The output terminal of flip-flop 604 comprises the "PSYNC" signal, which will be synchronized to the negative going transition of the "RCLKX8" signal. The "PSYNC" signal is the clock signal of flip-flop 606. The data terminal of flip-flop 606 is coupled to the positive supply voltage. The "$\overline{Q}$" output of flip-flop 606 is coupled as one input to AND gate 608.

The output of OR gate 608 is coupled to flip-flop 610. The clock signal of flip-flop 610 is the "RCLKX8" signal. The "Q" output of flip-flop 610 is coupled to the clock input of flip-flop 612. The inverted output of flip-flop 610 is coupled to the reset terminal of flip-flop 606.

Flip-flop 612 comprises a buffer element, whose input comprises the output data "RQ" from the random access memory at a clock rate depending upon the Q output clock frequency of flip-flop 610. The output of flip-flop 612 comprises the "DECODER DATA" signal which is used as the digital data signal to the delta demodulator circuit 400.

Flip-flop 614 ensures that the writing of data takes priority over the reading of data from the random access memory. The clock signal of flip-flop 614 is the output clock signal "RCLK." The data signal is the positive supply voltage, and the output signal "Q" is coupled to the input of NAND gate 608. The reset terminal of flip-flop 614 is coupled to the Q output of flip-flop 616.

Flip-flop 616 is clocked by "RCLKX8" at a rate equal to eight times the input clock signal. The inverted output of flip-flop 616 comprises one input to OR gate 618, the other input is the input clock signal times 8 frequency. The output of OR gate 618 is the "$\overline{RW}$" signal. The noninverted input of flip-flop 616 is the "RECGRANT" signal which goes "high" to start the write cycle, while the $\overline{RW}$ signal, when "low," starts the read cycle from RAM 660.

Referring now to FIG. 5, the multiplexing and memory circuitry will now be described. RAM 660 is a 1K by 1 bit RAM of the HM-6508-2 type. Its output "Q" is the "RQ" signal which is the data input to flip-flop 612.

Counters 650 and 652 comprise respectively 10 stage ripple counters of the type CD4040 A and B counters. The clock input to counter 650, which acts as the right counter, is the "RLCK" or input clock signal frequency. The clock of counter 652 is the "PSYNC" signal.

Element 654 comprises an AND/OR select gate of the type CD4019. Its input terminals A1, A2, and B1 and B2 are coupled respectively to the P8 and P9 terminals of counter 652 and terminals R8 and R9 of counter 650.

Element 656 is a select gate of the type CD4019 series. Its terminal input terminals are coupled respectively to the P4 through P7 and R4 through R7 output terminals of counters 652 and 650. Its data outputs D1, D2, D3 and D4 are coupled respectively to the address line A4, A5, A6 and A7 of RAM 660.

Element 658 is a select gate of the CD4019 series. Its input lines are coupled respectively to the P0, P1, P2 and P3 terminals of read counter 652 and terminals R0, R1, R2 and R3 of write counter 650. Its data output terminals D1, D2, D3 and D4 are coupled respectively to the address input lines A0, A1, A2 and A3 of RAM 660. The "PLAY GRANT" signal is coupled to the "KA," i.e., select A register input terminals of devices 658, 656 and 654, respectively selecting the appropriate output signals of counter 652. The signal "REC-GRANT" is coupled respectively to the "KB" selector terminals of devices 658, 656, 654, thereby respectively selecting the terminals from the 650 counter.

The outputs of counters 650 and 652 comprise, respectively, the read and write addresses for the RAM. The address multiplexer selects from counter 650 or 652, depending upon whether the device is in a read or write mode, as selected by the priority logic and signals "REGRANT" and "PLAYGRANT."

Figure 6A:
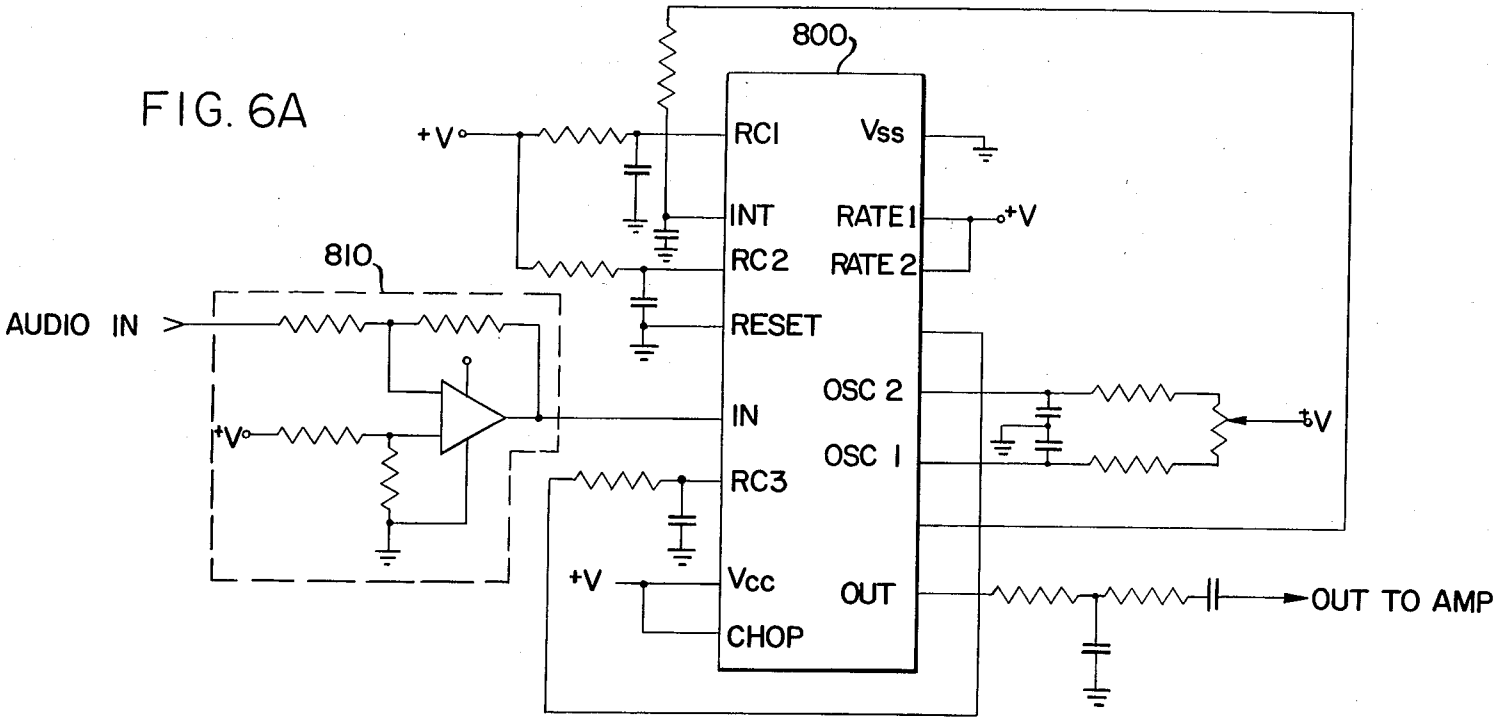
FIGS. 6A and 6B illustrate circuits of the preferred embodiment utilized in a radio application.
Figure 6B:
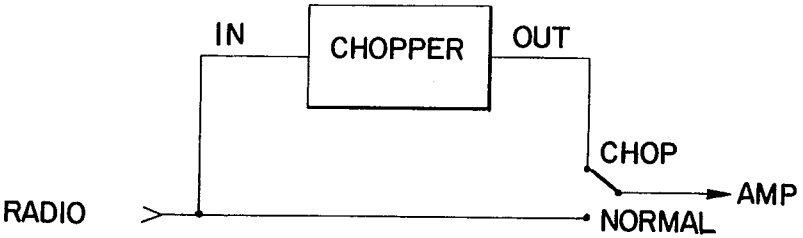

Referring now to FIG. 6, a schematic diagram illustrating the circuit of the present invention in a custom LSI format, used in a radio application, is disclosed. Thus, the frequency translation circuitry may be switched in and out from the normal radio output to selectively introduce frequency translation effects. Custom LSI chip 800 incorporates the circuitry emulated in FIGS. 2 through 5. Amplifier 810 amplifies the audio input signal which is provided to the "N" terminal of chip 800. The remaining terminals of the chip comprise the various resistive and capacitive components which set levels, clock frequencies and the like.

The frequency multiplication apparatus of the preferred embodiment operates in the following manner. The input analog signal is amplified and its level compared to the level of a reference signal. The comparator output is a two-state signal, whose state will depend upon the comparison result, i.e., "high" if the input level is above that of the reference signal, and "low" if vice versa. The comparator output is sampled by a D flip-flop once every input clock period. The reference signal of the comparator is the level of an integrator circuit.

The step size of the modulator is a well-known variable of delta modulators, and describes possible changes in the reference level during a clock period. In continuously variable slope delta ("CVSD") modulators, the step size is adjusted in accordance with the characteristics of the analog input signal, to conform the encoding operation to the dynamic characteristics of the signal. Thus, for low magnitude or low frequency signals, a small step size is desirable, while with high frequency or large amplitude signals, a larger step size is necessary to obtain good fidelity from the encoding operation.

Prior art CVSD modulators, for example the aforementioned Motorola device, monitor the comparator signal for three clock cycles. If the signal remains in the same state for three clock periods, this indicates that the signal is either relatively sharply increasing or decreasing, i.e., with a relatively steep slope. The circuit adjusts the step size to increase the integrator gain to compensate for the high slope condition. The Motorola device uses a linear multiplier to convert the voltage level from the syllabic filter to a current source to drive the integrator.

The preferred embodiment utilizes a novel delta modulator circuit wherein the integrator is controlled by a switch gated by a simple one-shot multivibrator circuit, which couples the sampled comparator output to the integrator capacitor. The comparator output is monitored by a three input exclusive NOR gate arrangement, which provides a "high" signal which the state of the comparator has not changed for three clock periods. The gate "high" signal biases the syllabic filter with a higher bias voltage than is present in the absence of the gate "high" signal. The syllabic filter capacitor level in turn provides the reference level to the comparator of a one-shot, variable pulse width multivibrator circuit. This circuit provides a pulse of variable width which operates to gate the switch "on" and "off."

The switch couples the output of a flip-flop, which is the comparator output, to the integrator capacitor through a 68 Kohm resistor. Thus, the longer the switch is closed, the greater the change in voltage level on the capacitor. Increasing the bias voltage level to the syllabic filter increases the reference level to the multivibrator comparator, and thereby widens the pulse width and the length of the interval in which the switch is closed.

The digital data from the modulator comprises a serial bit stream, which is read into sequential address locations of the RAM at the input clock rate. The digital processor is operative to perform the sequential writing of the digital data in a time multiplex fashion with the reading of the data from the RAM.

The output demodulator decodes the digital data read from the RAM in a serial bit stream and also from sequential address locations. The rate at which the data is read from memory is determined by the output clock signal frequency. The multiplexer and priority logic operates to ensure that the reading and writing operations are performed without conflict, the writing operation having priority over the read operation.

In a time-multiplexed fashion, the input data is written sequentially to each location of the RAM. After location 1,023 is written to, the next location is 0. Simultaneously, output data is being read sequentially from each location of RAM, location 0 following location 1,023.

It will be appreciated that, due to the disparity in the input and output clock frequencies and the fact that only a finite number of sequential memory locations are available, a periodic discontinuity will occur in the demodulated signal. In the preferred embodiment, 1,023 sequential memory locations are available, with the addressing circuitry operating to cause the memory to be addressed in a circulating fashion, i.e., the ext successive address location of the location 1,023 is location 0. With different input and output clock frequencies, the read (or write) operation will periodically overtake the write (or read) operation address, causing a discontinuity in the output analog signal. The period P of the discontinuity is related to the output clock rates and the size S of the RAM, such that P equals S divided by the magnitude of the difference between the input and output clock frequencies.

Prior art schemes have used blanking circuits to mask the discontinuity. In the preferred embodiment, it is found that the characteristics of the novel delta modulator tends to mask the discontinuity.

The delta demodulator operates in an inverse fashion relative to the modulator to decode the digital data from the RAM into analog data. The digital data is used to charge an integrating capacitor through a swtich gated "on" or "off" by a variable pulse width multivibrator. An R-C network having the same time constant as the corresponding network in the modulator circuit couples the slope signal from the syllabic filter as the reference to the comparator of the demodulator multivibrator.

Using the same slope control signal to control the compensation of the demodulator circuit provides a simplified circuit, and an additional advantage. It is desired that the decoded signal have the same dynamic characteristics as the input analog signal, even though the frequency has been multiplied by a ratio factor. Having the same slope control signal control the gain of both the modulator and demodulator integrators accomplishes this result.

One advantage of the circuit described herein is that it is readily adapted to LSI techniques. The sensitive linear multipliers of the prior art have been replaced with a simplified switch arrangement. With the relatively low sampling rate of the delta modulator, a small RAM may be employed. The circuit may be implemented in a variety of applications, such as sound effects devices, accessories for the music industry and the like. One may, of course, improve the fidelity of the device by using a larger memory and running the delta modulator at a higher clock rate.

As is well known in the art, implementing the circuit in CMOS LSI would result in elimination of diodes as shown in the emulator circuits, and replacing the diodes with open-drain configurations.

The novel delta modulator of the present invention has a wide dynamic range, due to the one-shot multivibrator arrangement. The period of the arrangement can be very low, with a very small step size.

What is claimed is:

1. An audio frequency signal processing circuit, adapted for frequency multiplication of analog audio signals, comprising:

integrator circuit means having an input for integrating a signal supplied to said input to provide a reference signal;

comparator means having first and second inputs and having an output for receiving said analog audio signal at said first input and said reference signal at said second input and for comparing said analog audio signal to said reference signal and generating a binary output in response to said comparison;

means responsive to an input clock signal for sampling said binary output to produce a plurality of successive binary sample outputs and for storing and shifting said plurality of successive binary sample outputs;

logic means for receiving said successive binary sample output from said sampling, storing and shifting means and responsive thereto to generate a logic output signal;

filter means supplied with said logic output signal for providing a filtered output signal;

first variable pulse width generator means receiving said filtered output signal as an input for generating an output pulse having a width proportional to the level of said filtered output signal;

first switch means for providing a connection between one of said binary sample outputs and the input of said integrator circuit means during the duration of the output pulse generated by said first variable pulse width generator means;

means for storing said successive binary sample outputs at a first rate determined by said input clock signal to form stored binary data and for outputting said stored binary data at a second rate determined by an output clock signal;

register means having a data input, a clock input and a Q output, for receiving at said data input the stored binary data outputted by said storing means, for receiving said output clock signal at said clock input, and for providing output binary data at said Q output;

integrator means having an input for integrating a signal presented to said input to provide a signal comprising the output of said audio frequency signal processing circuit;

second variable pulse width generator means receiving said filtered output signal of said filter means as an input and for generating an output pulse having a width proportional to the level of said filtered output signal;

second switch means for providing a connection between said Q output and the input of said integrator means during the duration of the output pulse generated by said second variable pulse width generator means; and clock means for generating said input clock signal and output clock signal and supplying said input clock signal to said means for sampling and to said storing means and for supplying said output clock signal to said storing means and to said register means.

2. The circuitry of claim 1 wherein said integrator circuit means comprises a capacitor having a first terminal connected to said second input of said comparator means; and a resistor having a first terminal supplying the said input of said integrator circuit means and a second terminal connected to the first terminal of said capacitor.

3. The circuitry of Claim 2 wherein said logic means receives three said binary sample outputs and generates a logic output signal only when said three binary sample outputs are of like value.

4. An audio frequency signal processing circuit, adapted for frequency multiplication of audio frequency signals, including:

a delta modulator circuit for converting an analog signal to digital data comprising:

comparator means having first and second inputs for receiving at said first input said analog signal, for receiving at said second input a reference signal, for comparing said analog signal to said reference signal, and for providing an output signal based upon the comparison of said analog signal and reference signal;

a charge storage means connected to said first input for providing said reference signal;

means for sampling said output signal to produce a plurality of digital samples comprising said digital data, for storing and shifting a plurality of said samples, and for providing a succession of said samples at a plurality of respective outputs;

digital logic means connected to said respective outputs for logically combining said samples to provide an output logic level;

filter means for filtering said output logic level to produce a filtered output voltage;

a variable pulse width generator means receiving said filtered output voltage as an input for generating a variable width output pulse, the width of said pulse being variable in accordance with the magnitude of said filtered output voltage;

a switch means responsive to a switch control signal for connecting one of said respective outputs of said sampling means to said charge storage means for the duration of said switch control signal;

wherein said switch control signal comprises said variable width output pulse said processing circuit further including:

means for storing said digital data at a first rate determined by said input clock signal to form stored digital data and for outputting said stored digital data at a second rate determined by an output clock signal;

said processor circuit further including a delta demodulator comprising:

register means having a data input, a clock input and a Q output, for receiving at said data input the stored digital data outputted by said storing means, for receiving said output clock signal at said clock input, and for providing output digital data at said Q output;

integrator means having an input for integrating a signal presented to said input to provide a signal comprising the delta demodulator output;

second variable pulse width generator means receiving said filtered output voltage of said integrator means as an input and for generating an output pulse having a width proportional to the level of said filtered output voltage;

second switch means for providing a connection between said Q output and the input of said integrator means during the duration of the output pulse generated by said second variable pulse width generator means;

clock means for generating said input clock signal and output clock signal, and for supplying said input clock signal to said means for sampling and to said storing means, and for supplying said output clock signal to said storing means and to said register means.

5. An audio frequency signal processing circuit, adapted for frequency multiplication of audio frequency signals, comprising:

a comparator circuit having a first input, a second input and an output, said audio frequency signals being supplied to said first input;

a capacitor having a first terminal and a reference terminal, the first terminal being connected to said second input of said comparator circuit;

a resistor having a first terminal connected to the first terminal of said capacitor and a second terminal;

a shift register having a data input, a clock input connected to receive an input clock signal and first, second and third stage outputs, said data input being connected to the output of said comparator circuit, one of said first, second and third stage outputs comprising digital output data;

an exclusive NOR logic gate having first, second and third inputs and a logic output, said first, second and third inputs being connected to said first, second and third stage outputs, respectively;

a low pass filter having an input connected to the logic output of said NOR logic gate and an output;

a first variable pulse width multivibrator means having an input connected to the output of said low pass filter and an output, said multivibrator means producing a pulse at an output terminal thereof proportional in width to the magnitude of the output of said low pass filter; and a first bilateral switch connected to the third output of said shift register and to the second terminal of said resistor and having a control terminal connected to the output terminal of said first variable pulse width multivibrator means;

means receiving as first and second clock inputs said first input clock signal and an output clock signal for storing said digital output data at a first rate determined by said clock signal to form stored digital data and for outputting said stored digital data at a second rate determined by said output clock signal;

a flip-flop having a data input, a clock input terminal and a Q output, connected for receiving at said data input the stored digital data outputted by said storing means and for receiving said output clock signal at said clock input terminal;

integrator means having an input for integrating a signal presented to said input to provide a signal comprising the output of said audio frequency processing circuit;

second variable pulse width multivibrator means receiving the output of said low pass filter as an input and for providing an output pulse at an output terminal thereof having a width proportional to the magnitude of the output of said low pass filter;

a second bilateral switch connected to said Q output and to the input of said integrator means and having a control terminal connected to the output terminal of said second variable pulse width multivibrator means;

clock means for generating said input clock signal and said output clock signal, said clock means comprising:

a potentiometer having first and second opposite terminals and a center wiper terminal;

first and second one-pin Schmitt RC oscillators, each respective oscillator pin being driven by a respective opposite terminal of said potentiometer, with the center wiper terminal of said potentiometer being connected to a reference voltage;

said clock means supplying said input clock signal to the clock input of said shift register and to said storing means and supplying said output clock signal to said storing means and to the clock input terminal of said flip flop.

6. An audio frequency signal processing circuit, adapted for frequency multiplication of audio frequency signals, comprising:

a passive integrator circuit means having an input for integrating a signal supplied to said input to generate a reference signal;

first comparator means having first and second inputs and having an output for receiving an audio frequency signal at said first input and said reference signal at said second input and for comparing said analog audio signal to said reference signal and generating a binary output in response to said comparison;

means responsive to an input clock signal for sampling said binary output to produce a plurality of successive binary sample outputs and for storing and shifting said plurality of successive binary sample outputs;

logic means for receiving said successive binary sample outputs from said sampling, storing and shifting means and responsive thereto to provide a logic output signal;

filter means supplied with said logic output signal for providing a filtered output signal;

first variable pulse width generator means receiving said filtered output signal as an input and for generating an output pulse having a width proportional to the level of said filtered output signal;

first switch means for providing a connection between one of said binary sample outputs and the input of said passive integrator circuit means during the duration of the output pulse generated by said first variable pulse width generator means;

means for storing said successive binary sample outputs at a first rate determined by said input clock signal to form stored binary data and for outputting said stored binary data at a second rate determined by an output clock signal;

flip-flop means having a data input, a clock input and a Q output, for receiving at said data input the stored binary data outputted by said means for storing, for receiving said output clock signal at said clock input, and for providing output binary data at said Q output;

integrator means having an input for integrating a signal presented to said input to provide a signal comprising the output of said audio frequency signal processing circuit;

second variable pulse width generator means receiving said filtered output signal of said filter means as an input and for generating an output pulse having a width proportional to the level of said filtered output signal;

second switch means for providing a connection between said Q output and the input of said integrator means during the duration of the output pulse generated by said second variable pulse width generator means; and clock means for generating said input clock signal and output clock signal, said clock means comprising:

a potentiometer having first and second opposite terminals and a center wiper terminal;

first and second one-pin Schmitt RC oscillators, each respective oscillator pin being driven by a respective opposite terminal of said potentiometer, with the center wiper terminal of said potentiometer being connected to a reference voltage;

said clock means supplying said input clock signal to said sampling means and to said storing means and supplying said output clock signal to said storing means and to the clock input of said flip-flop means.

* * * * *